US006467492B2

(12) United States Patent
Hopkins et al.

(10) Patent No.: US 6,467,492 B2
(45) Date of Patent: Oct. 22, 2002

(54) CORROSION INHIBITORS

(75) Inventors: William Hopkins, Leeds (GB); Christopher Nettleship, Leeds (GB)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 09/792,761

(22) Filed: Feb. 23, 2001

(65) Prior Publication Data

US 2001/0045546 A1 Nov. 29, 2001

(30) Foreign Application Priority Data

Feb. 23, 2000 (GB) ..... 004299

(51) Int. Cl.[7] ..... B08B 9/027; E21B 37/08; E21B 37/00

(52) U.S. Cl. ..... 134/22.14; 507/244; 507/265; 507/263; 507/927; 507/928; 507/930; 507/931; 507/939; 507/239; 507/932; 166/312; 166/342.4; 134/14

(58) Field of Search ..... 507/200, 203, 507/239, 209, 244, 218, 263, 266, 267, 265, 927, 928, 929, 930, 931, 932, 939; 252/389.1, 390, 392, 396; 166/250.04, 250.05, 311, 312, 242.4; 106/14.13, 14.15, 14.22, 14.24, 14.42; 134/14, 21, 22.11, 22.12, 22.14

(56) References Cited

U.S. PATENT DOCUMENTS 3,722,594 A * 3/1973 Smith et al. ..... 166/279
3,962,122 A * 6/1976 Trial ..... 252/392
4,028,117 A * 6/1977 Moat ..... 106/14
4,136,747 A 1/1979 Mallory et al.
4,261,842 A * 4/1981 Busch et al.
4,460,482 A * 7/1984 Wu
4,536,222 A 8/1985 Settineri et al.
4,543,131 A * 9/1985 Purinton, Jr. ..... 134/8
4,775,418 A * 10/1988 Laemmle et al. ..... 106/38.24
4,830,827 A 5/1989 Au et al.
4,950,411 A * 8/1990 Treybig ..... 252/390
4,950,474 A * 8/1990 Hinrichsen et al. ..... 422/15
5,027,901 A * 7/1991 French et al. ..... 166/310
5,346,339 A * 9/1994 Himes et al. ..... 405/171
5,589,138 A * 12/1996 Drechsler ..... 422/108
5,753,596 A * 5/1998 Martin et al. ..... 507/237
5,888,947 A * 3/1999 Lambert et al. ..... 508/491
6,004,923 A * 12/1999 Oftring et al. ..... 510/499
6,042,750 A * 3/2000 Burlew ..... 252/387
6,063,447 A * 5/2000 Morand et al. ..... 427/388.4
6,146,620 A * 11/2000 Janowski et al. ..... 424/73
6,281,174 B1 * 8/2001 Haruna ..... 508/322

FOREIGN PATENT DOCUMENTS

| | | |
|---|---|---|
| CA | 957910 | 11/1974 |
| EP | 0286336 | 10/1988 |
| GB | 2 040 732 A | 9/1980 |
| GB | 2 064 985 A | 6/1981 |
| GB | 2 222 583 A | 3/1990 |

* cited by examiner

*Primary Examiner*—Joseph D. Anthony
(74) *Attorney, Agent, or Firm*—Lowe Hauptman Gilman & Berner, LLP

(57) ABSTRACT

A method of preventing corrosion in pipelines comprising draining pipeline of all residual compounds, blowing through with nitrogen and rinsing with a corrosion inhibiting rinsing agent.

12 Claims, No Drawings

CORROSION INHIBITORS

This invention relates to corrosion inhibitors primarily, but not exclusively, for use with oil well exploration and development pipelines. The invention relates more specifically to use with 'coiled tubing'.

The coiled tubing is typically a flexible steel pipe several kilometres in length with an internal diameter in the region of 5 centimeters. It is supplied and used by sub-contractors who provide such services as 'well conditioning' and inspection to oil production and exploration companies. While carrying out these operations various solutions may be circulated through the coiled tubing, for example 'scale dissolver'. While the exact compositions of these solutions are closely guarded secrets, each sub-contractor having their own proprietary blends. It is known that most are based on hydrochloric acid or other such corrosive compounds.

On completion of a contract, to prevent corrosion of pipes by any residual scale dissolvers etc, the pipes are rinsed. A typical procedure for rinsing and cleaning the coiled tubing is to purge with nitrogen, rinse with a caustic solution to neutralise any acidic residues in an attempt to minimise corrosion, then purge again with nitrogen. Most of the corrosion occurs between jobs.

Prior to committing a coiled tube to further contracts it is inspected and pressure tested. Although pipes are rinsed after a period of sustained use, almost invariably heavy internal corrosion caused by use of acid conditioning agents, and from bi-products of the rinsing process means that before pressure testing there is a need to clean the tube by 'acid pickling' to remove the corroded surface. This continuous cycle of corrosion and cleaning results in the walls of the tubing becoming thinned. The thinned walls increase the likelihood of pin holes forming and therefore leaks in the tubing during use, resulting in expensive downtime for the sub-contractor.

Although the need to find a solution to the problem of internal corrosion of coiled tubing has been recognised by the sub-contract companies, so far they have made little progress. The addition of caustic solution to neutralise the acids has proved ineffective, and may actually be accelerating the corrosion by forming sodium or potassium chlorides in situ which are known to be highly corrosive to steel. Another avenue that has been explored is the application of dry film resin bonded coatings to the internal surface of the tubing, however this has proved to be expensive and difficult to apply, therefore limiting it's use.

THE INVENTION

The present invention relates to a method of preventing corrosion in pipelines comprising draining pipeline of all residual compounds, blowing through with nitrogen and rinsing with a rinsing agent, characterised in that the rising agent is corrosion inhibiting. The rinsing agent cleans out and neutralises any acid residues and leaves a corrosion inhibiting oily film. Preferably, the pipeline is rinsed with the rinsing agent immediately after use.

Also according to the present invention, a pacifier corrosion inhibiting rinsing agent comprises an emulsifable oil and passifier materials.

In a preferred embodiment of the present invention, the corrosion inhibiting rinsing agent is biodegradable and consists of a mixture of one or more vegetable oil derived base oils, one or more emulsifiers, and one or more corrosion inhibitors.

As the product would be for use offshore, it is necessary for the corrosion inhibiting rinsing agent to be biodegradable, this would then prevent any serious harm to aquatic organisms in the event of spillage After the use of a section of coiled tubing in a process such as well conditioning, all residual conditioning solutions are drained from the pipeline and the pipeline removed from the well assembly. The pipeline is then blown through with nitrogen and then immediately rinsed with a corrosion inhibiting rinsing agent of the present invention. This agent has the effect of neutralising any residual acidic solutions which cause corrosion of the pipeline due to the neutralising effect of the triethanolamine. Once this rinsing solution has been flushed through the pipeline the oily nature of the composition, due to the vegetable oil and methyl ester content, 'plates out' a protective film which adheres to the inner surface of the tube. This effect is enhanced by the use a mixed anionic/non-ionic emulsifier system which results in the oil droplets of the emulsion becoming larger, more unstable and therefore more likely to 'plate out' as the acidity increases.

The prior art is simply the use of a caustic rinse on the tubing, no other system to neutralise or prevent further corrosion is in use.

The corrosion inhibiting rinsing agents of the invention can be used either by flushing through the pipe as a dilute solution or by introducing and passing a "plug" of neat rinsing agent through the pipe.

The above and other features of the present invention are illustrated by the following examples of corrosion inhibiting rinsing agents in accordance with the present invention.

| Composition 1 | |
|---|---|
| Methyl tallowate | 35.0% (a Methyl ester base oil) |
| 7–10 P Blown Rape Seed Oil | 35.0% (a vegetable oil) |
| Polydiethanolamide | 10.0% (a corrosion inhibitor) |
| Triethanolamine | 10.0% (an Amine) |
| Etocas 29 | 10.0% (Ethoxylated castor oil) |

were mixed together to form Composition 1, a semi-translucent liquid.

Testing

A 5"×3" (127 mm×76.2 mm) mild steel panel was immersed an acid solution (16% HCl) for 5 minutes, removed and placed in a 10% solution of Composition 1 for 1 minute and then taken out.

The panel stayed clear with no sign of corrosion after 24 hours. When allowed to dry, a very light oil film was left behind.

In a comparative test using a rinse solution of 0.5% KOH solution, rusting was observed within 1 minute.

| Composition 2 | |
|---|---|
| Lubriol 929.65 | 58.0% |
| 7–10 P Blown Rape Seed Oil | 10.0% |
| Polydiethanolamide | 10.0% |
| Triethanolamine | 10.0% |
| Rewopol CT | 2.0% (Polyether Carboxylic Acid, a lime scale dispersant) |
| De-ionised Water | 3.0% |
| Etocas 29 | 7.0% |

Testing

Three pipe sections were immersed in an acid etch solution (16% HCl) this was followed by soaking in 10% dilutions of Composition 2 for 5 minutes. The pipes were then exposed to air.

When the pipe was allowed to dry, no corrosion was seen after 2 hours. When the pipes remained wet (at the bottom of the 'U"section'), a small amount of corrosion was observed.

| Composition 3 | |
|---|---|
| Fatty ester | 22.5% (Epoil HL - obtainable from Homett Bros) |
| 7–10 P Blown Rape Seed Oil | 22.5% (a vegetable oil) |
| Sunflower Oil | 9.0% |
| Polydiethanolamide | 10.0% |
| Triethanolamine | 20.0% |
| Tall oil fatty Acid | 2.0% (a mixture of oleic and linoleic acids plus 22% maximum Rosin acids) |
| Rewopol CT | 2.0% (Polyether Carboxylic Acid, a lime scale dispersant) |
| Demineralised water | 10.0% |
| Fatty alcohol polyglycol ether | 3.0% (Emulsogen M - obtainable from Hoechst) |

The Emulsogen M was added to stabilise the formulation to form Composition 3 which gave a clear fluid.

The fatty acid ester was added to clean tank having a paddle mixer. The mixer was started and the 7-10P blown rape seed oil, sunflower oil, polydiethanolamide, triethanolamine, tall oil fatty acid and rewopol CT were added to the tank and mixed for 15 minutes. The demineralised water and fatty alcohol polyglycol ester were then added to the tank and the mixture mixed for a further 60 minutes.

Samples of Composition 3 were put in a refrigerator at 5° C. and in an oven at 40° C. and both were stable after 48 hours.

Testing

Samples of Composition 3 were emulsified at dilutions of 10:1, 20:1, 30:1 and 40:1 in water and were tested according to the IP287 Corrosion Test Procedure (The Institute of Petroleum 'standard methods for analysis and testing of petroleum and related products')

At dilutions of 10:1, 20:1, 30:1 the panels showed a definite pass of the test, but at 40:1 dilution only a borderline pass was achieved.

In a further test of Composition 3, a section of tubing as used in the field was immersed in a 16% hydrochloric acid solution for 4 hours (to simulate the pumping of the conditioning solution). It was then removed and immediately immersed in a 10% v/v (in tap water) solution of Composition 3 for one minute. The section of tube was then removed and left open to the atmosphere. For comparison a second section of tube was immersed in tap water for one minute, as per the current practice.

The results were as follows:

| Rinsing solution | Results |
|---|---|
| Tap water | Surface rusting observed after 5 minutes, 100% corrosion after one hour |
| 10% Composition 3 | Surface free from corrosion after 72 hours (test stopped) |

In a further field test, a sample of Composition 3 was submitted to a coiled tubing contractor for field evaluation. Employing the "plug" method, a 20% emulsion of Composition 3 was passed through the tubing. The tubing was then sealed and stored for a period of two months. After this time, sections of tubing were cut open and inspected. The surfaces were found to free from corrosion.

BIODEGRADABILITY

All of the above formulations consist of a vegetable oil derived base fluid with additives for emulsification, corrosion inhibition and alkaline reserve in which all the components are at least 90% biodegradable.

For example, in Composition 3 the fatty ester, 7-10P blown rape seed oil and sunflower oil constitute the vegetable oil derived base fluid, the triethanolamine, tall oil fatty acid and fatty alcohol polyglycol ester constitute an emulsifying agent, polydiethanolamide and triethanolamine constitute alkaline reserve and corrosion inhibitors, rewopol CT serves to prevent scum formation due to reaction of the tall oil fatty acid with calcium ions in the water To confirm the biodegradability of these formulations, a sample of Composition 3 was tested according to method OECD 306 (ready biodegradation test as required by the Harmonised Offshore Chemical Notification Format guidelines).

What is claimed is:

1. A method of at least reducing corrosion in pipelines comprising draining of all residual compounds, blowing through with nitrogen and rinsing with a biodegradable rinsing agent comprising an amine corrosion inhibiting agent that neutralizes acid residues on said pipeline and at least one vegetable based oil that plates out a protective oily residue on the inside surface of said pipeline.

2. A method as claimed in claim 1 where use is in oil well exploration and development pipelines.

3. A method as claimed in claim 1 where the pipeline is coiled steel tubing.

4. A method as claimed in claim 1 where the pipeline is coiled steel tubing several kilometres long and having a 5 cm internal diameter.

5. A method as claimed in claim 1 wherein said method is carried out substantially immediately after use.

6. A method as claimed in claims 1 and wherein the rising agent is diluted before use.

7. A method as claimed in claim 1 wherein said amine comprises triethanol amine.

8. A method as claimed in claim 1 wherein said rinsing composition comprises a methyl ester, a vegetable oil that is different from said methyl ester, a diethanol amide corrosion inhibitor, triethanolamine, and an ethoxylated castor oil.

9. A method as claimed in claim 1 wherein said rinsing agent comprises: a fatty ester, rape seed oil, sunflower seed oil, polydiethanol amide, trietheanol amine, tall oil, a lime scale dispersant, and a fatty alcohol polyglycol ester that is different from said fatty ester, said sunflower seed oil and said rape seed oil.

10. A method as claimed in claim 1 wherein said rinsing agent does not contain caustic.

11. A method as claimed in claim 1 wherein said rinsing agent further comprises at least one emulsifier and at least one additional corrosion unhibitor.

12. A method as claimed in claim 11 wherein said emulsifier comprises a mixed anionic/non-ionic emulsifier system.

* * * * *